US011624258B2

(12) United States Patent
AlOmair

(10) Patent No.: US 11,624,258 B2
(45) Date of Patent: Apr. 11, 2023

(54) FAIL-SAFE STAGE TOOL AND DOWN HOLE SENSOR

(71) Applicant: Saudi Arabian Oil Company, Dhahran (SA)

(72) Inventor: Ahmad Abdullatif AlOmair, Hofuf (SA)

(73) Assignee: Saudi Arabian Oil Company, Dhahran (SA)

( * ) Notice: Subject to any disclaimer, the term of this patent is extended or adjusted under 35 U.S.C. 154(b) by 43 days.

(21) Appl. No.: 17/399,542

(22) Filed: Aug. 11, 2021

(65) Prior Publication Data

US 2023/0048397 A1 Feb. 16, 2023

(51) Int. Cl.
*E21B 33/16* (2006.01)
*E21B 47/005* (2012.01)

(52) U.S. Cl.
CPC ..... *E21B 33/165* (2020.05); *E21B 47/005* (2020.05)

(58) Field of Classification Search
CPC ..... E21B 33/13; E21B 33/14; E21B 33/16; E21B 33/165; E21B 33/167; E21B 47/005
See application file for complete search history.

(56) References Cited

U.S. PATENT DOCUMENTS 6,408,943 B1 6/2002 Schultz et al.
7,594,434 B2 9/2009 Dagenais et al.
9,617,829 B2 4/2017 Dale et al.
9,683,440 B2 * 6/2017 Brown-Kerr ..... G01V 11/002
10,738,590 B2 * 8/2020 Ravi ..... E21B 47/005
11,143,015 B2 * 10/2021 Pearl, Jr. ..... E21B 47/005
2003/0029611 A1 2/2003 Owens
2008/0023205 A1 * 1/2008 Craster ..... E21B 33/127 166/387
2014/0054036 A1 * 2/2014 Regener ..... E21B 7/20 175/57
2014/0338896 A1 * 11/2014 McGarian ..... E21B 47/005 166/250.08
2018/0179857 A1 6/2018 Themig
2019/0128115 A1 * 5/2019 AlNughaimish ..... E21B 47/117
2021/0238978 A1 * 8/2021 Singh ..... G01V 1/52
2021/0238983 A1 * 8/2021 Singh ..... E21B 47/01

FOREIGN PATENT DOCUMENTS

WO 2016133524 A1 8/2016

* cited by examiner

*Primary Examiner* — Shane Bomar
(74) *Attorney, Agent, or Firm* — Dinsmore & Shohl LLP

(57) ABSTRACT

A fail-safe method to cement a section of casing string to a formation is provided. The method includes providing the casing string in a wellbore, the casing string comprising a stage tool, a packer, and a sensor. The packer is located vertically below the stage tool and vertically above the sensor on the casing string. The method further includes pumping cement down the casing string and up an annulus to an expected height, the expected height being a vertical distance above the sensor, and detecting a presence or absence of cement with the sensor. If the sensor detects the presence of cement, the stage tool is kept closed and the packer is kept deflated. If the sensor detects the absence of cement, the stage tool is opened and the packer is inflated.

11 Claims, 1 Drawing Sheet

FAIL-SAFE STAGE TOOL AND DOWN HOLE SENSOR

TECHNICAL FIELD

Embodiments of the present disclosure generally relate to stage cementing methods in wellbores and, more specifically, to a fail-safe method to cement a section of casing string above a potential loss zone in a wellbore.

BACKGROUND

In a typical well construction, a section of wellbore is drilled to a desired depth, casing string is placed in the wellbore and the exterior surface of the casing string is cemented to the formation. Cementing can be a crucial part of the well construction process. Cement provides a hydraulic seal that advantageously anchors and supports the casing string while protecting it from corrosion that could otherwise occur from exposure to formation fluids. Cement further blocks the escape of fluids in the formation to the surface and prevents fluid communication between different producing zones in the wellbore.

Cementing operations can comprise primary cementing and remedial cementing. Primary cementing is typically performed by pumping cement down the interior of the casing string through the last casing shoe and up the annulus to an expected height. Ideally, primary cementing would be the only cementing procedure used during well construction. However, in many cases primary cementing is insufficient to render the well viable. Accordingly, remedial cementing, an expensive procedure, is often needed to supplement primary cementing.

After performing a primary cementing operation, the cement is allowed to set. At this point, engineers normally conduct tests to determine if the primary cementing operation was successful. Such tests can involve pressure testing and logging to determine whether solid cement is bonded to the casing string as well as the mechanical integrity of the cement/casing string and cement/formation interfaces. In many cases, the tests indicate that the primary cement operation was defective and remedial cementing is needed to make the well viable.

When engineers detect an interval of the wellbore devoid of cement or that has defective cement bonding, remedial cementing can be used as a corrective measure. A common remedial cementing technique is squeeze cementing. In this technique, a cementing crew perforates the casing at a defective interval and forces cement through the perforations and into the annulus to fill cement voids. Remedial cement procedures can add significant costs and time to well construction. Accordingly, when engineers anticipate that cement will be lost to an interval in the formation, stage tools are often incorporated in the casing string as a proactive measure.

A stage tool allows primary cementing to be conducted in multiple stages. Multi-stage cementing is a method most often used to protect weak zones in the formation from the hydrostatic pressure of a full cement column. Pressure at a weak zone increases as the height of a cement column is increased above the weak zone. Eventually, pressure at the weak zone may be high enough to fracture the formation at the weak zone. In these cases, cement is lost to the weak zone, which can make it near impossible to bring the top of the cement to a desired height. By incorporating a stage tool in the casing string just above the weak zone, cement can be brought to a desired height without losses to the weak zone.

To cement in multiple stages in the presence of a weak zone, cement may be first pumped down the casing string and up the annulus until the height of the cement reaches the weak zone. Afterwards, a packer incorporated in the casing string just above the weak zone may be inflated to fill the annular space between the casing string and the formation and create an occlusive seal. A stage tool incorporated in the casing string just above the packer may then be activated and opened. Cement is pumped down the casing string and through the open stage tool to fill the annulus above the packer to a desired height. Due to the gap in cement created by the packer, the pressure at the weak zone is mitigated.

Stage tools may also be incorporated in the casing string when an interval in the formation cannot support any cement. In those cases, the annulus is cemented to the bottom of the interval and a stage tool and packer is placed just above the interval to cement the annulus above the top of the interval.

While stage tools can be invaluable for completing cementing operations in difficult formations, they are sometimes used sparingly because their use adds complexity, time, and cost to the well construction process. However, the failure to utilize a stage tool when needed could at a minimum require the use of an expensive and time consuming remedial cement job to render the well viable. Further, remedial cement jobs are not always successful and thus, the failure to cement sections of casing string could limit the well integrity, limit the lifetime of the well, result in the mixing of reservoir fluids from different reservoirs, or lead to structural failure and collapse of the casing string. Accordingly, there is a need for a method to detect when the use of a stage tool in the casing string is desirable. Embodiments provided herein meet this need by incorporating a sensor on the casing string below a stage tool to detect a presence or absence of cement.

SUMMARY

A fail-safe method to cement a section of casing string to a formation is provided. The method includes providing the casing string in a wellbore, the casing string comprising a stage tool, a packer, and a sensor. The packer is located vertically below the stage tool and vertically above the sensor on the casing string. The method further includes pumping cement down the casing string and up an annulus to an expected height, the expected height being a vertical distance above the sensor, and detecting a presence or absence of cement with the sensor. If the sensor detects the presence of cement, the stage tool is kept closed and the packer is kept deflated. If the sensor detects the absence of cement, the stage tool is opened and the packer is inflated.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings.

DETAILED DESCRIPTION

The present disclosure is directed to a fail-safe method to cement a section of casing string to a formation in a wellbore.

Figure 1A:
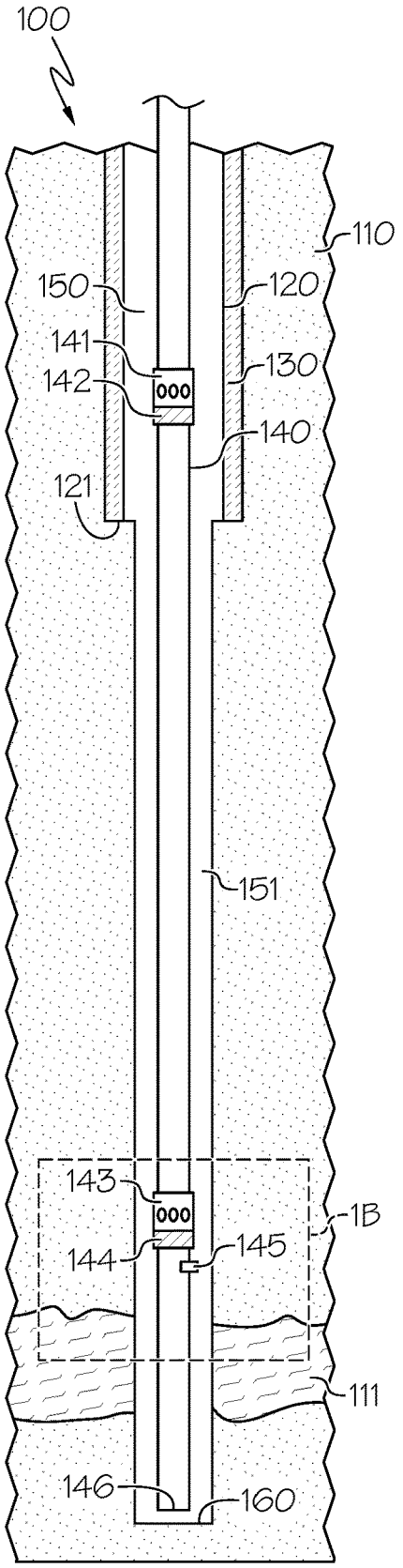
FIG. 1A schematically depicts a section of casing string in a wellbore according to one or more embodiments described herein.

FIG. 1A depicts a section of wellbore 100 according to embodiments. Wellbore 100 comprises a formation 110. In embodiments, wellbore 100 comprises an outer casing string 120. In one or more embodiments, outer casing string 120 comprises segments of steel pipe. In some embodiments, outer casing string 120 has an outer diameter of from 4 inches to 20 inches, from 6 inches to 19 inches, from 8 inches to 19 inches, from 9 inches to 19 inches, from 10 inches to 19 inches, from 12 inches to 19 inches, about 18⅝ inches, or about 13⅜ inches.

Outer casing string 120 may be cemented to formation 110 with cement 130 in a primary cementing operation. In some embodiments, cement 130 comprises Portland cement. After cementing with cement 130 is completed, the wellbore 100 may be drilled to a total depth 160 using a drill (not shown) lowered into the interior of outer casing string 120. Inner casing string 140 may then be provided in wellbore 100.

Inner casing string 140 may have a smaller diameter than outer casing string 120. According to one or more embodiments, inner casing string 140 comprises segments of steel pipe. In embodiments, inner casing string 140 has an outer diameter of from 4 inches to 20 inches, from 6 inches to 19 inches, from 8 inches to 16 inches, from 9 inches to 14 inches, about 13⅜ inches, or about 9⅝ inches. Usually, well construction comprises installing several casing strings, each requiring a primary cementing operation. As the well deepens, the diameter of each casing string is usually smaller than the preceding one.

Inner casing string 140 may comprise casing stage tool 141 and casing packer 142. Casing packer 142 is positioned vertically below casing stage tool 141. Casing packer 142 may be a separate device from the casing stage tool 141. Alternatively, casing packer 142 and casing stage tool 141 may comprise one device. Casing stage tool 141 and casing packer 142 are appropriately sized depending on the diameter of inner casing string 140.

Casing stage tool 141 and casing packer 142 may be positioned to cement an inner casing to outer casing annulus 150 between an outer surface of inner casing string 140 and an inner surface of outer casing string 120. In embodiments, casing packer 142 is positioned between 1 foot and 200 feet, 1 foot and 100 feet, 5 feet and 90 feet, 10 feet and 80 feet, 15 feet and 75 feet, 20 feet and 70 feet, 25 feet and 65 feet, 30 feet and 60 feet, 40 feet and 60 feet, or 45 feet and 55 feet above outer casing string bottom 121.

Referring again to FIG. 1A, inner casing string 140 may further comprise open hole stage tool 143, open hole packer 144, and sensor 145. In embodiments, open hole stage tool 143 may be positioned vertically above open hole packer 144 and open hole packer 144 may be positioned vertically above sensor 145 on inner casing string 140. Open hole stage tool 143, open hole packer 144, and sensor 145 may each comprise separate devices, may comprise one device, or may comprise two devices. In some embodiments, open hole stage tool 143 and open hole packer 144 comprise one device and sensor 145 comprises a separate device. According to one or more embodiments, open hole stage tool 143 and sensor 145 comprise one device and open hole packer 144 comprises a separate device. In some embodiments, open hole packer 144 and sensor 145 comprises one device and open hole stage tool 143 comprises a separate device.

In some embodiments, open hole stage tool 143 may operate through a hydraulic or mechanical mechanism as is known in the art. According to one or more embodiments, a flexible plug from a first stage cementing may seal open hole stage tool 143 from the interior of inner casing string 140 below open hole stage tool 143 and open hole stage tool 143 may be opened by applying a differential pressure. In some embodiments, open hole stage tool 143 may be opened by applying a differential pressure after dropping a dart or plug separate from the first stage cementing to seal open hole stage tool 143 from the interior of inner casing string 140 below open hole stage tool 143. Open hole stage tool 143 may be appropriately sized depending on the diameter of inner casing string 140. In embodiments, open hole stage tool 143 has the same specifications as casing stage tool 141. According to one or more embodiments, open hole stage tool 143 has different specifications than casing stage tool 141.

Figure 1B:
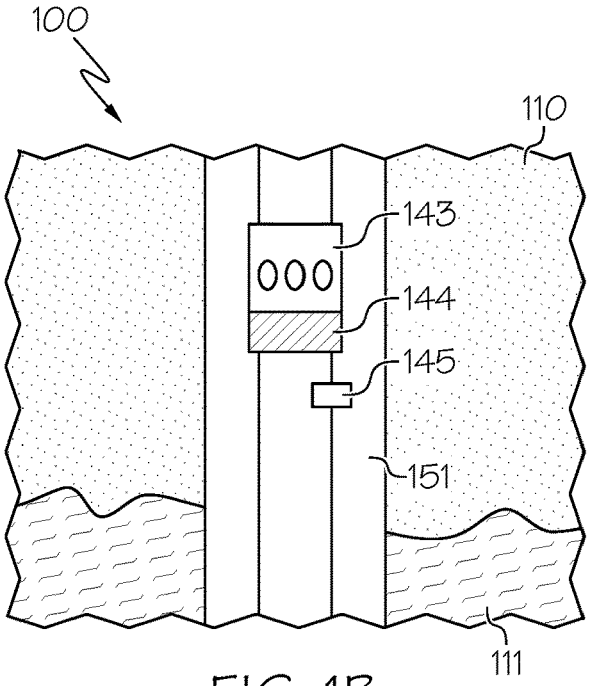
FIG. 1B schematically depicts a blown-up section of FIG. 1A according to one or more embodiments described herein.

Referring to FIGS. 1A and 1B, open hole packer 144 may operate through a mechanical or inflatable mechanism as is known in the art to create an occlusive seal between inner casing string 140 and formation 110 that separates annulus 151 above open hole packer 144 from annulus 151 below open hole packer 144. In some embodiments, open hole packer 144 may inflate by applying a differential pressure to the interior of inner casing string 140 after dropping a plug. According to one or more embodiments, open hole packer 144 operates through a mechanical mechanism.

At least part of sensor 145 is in contact with an annulus 151 in order to detect the material in annulus 151. In embodiments, sensor 145 may be positioned above potential loss zone 111. In some embodiments, sensor 145 may be positioned between 1 foot and 200 feet, 1 foot and 100 feet, 5 feet and 90 feet, 10 feet and 80 feet, 15 feet and 75 feet, 20 feet and 70 feet, 25 feet and 65 feet, 30 feet and 60 feet, 40 feet and 60 feet, or 45 feet and 55 feet above potential loss zone 111. According to one or more embodiments, sensor 145 is positioned between 1 foot and 200 feet, 1 foot and 100 feet, 5 feet and 90 feet, 10 feet and 80 feet, 15 feet and 75 feet, 20 feet and 70 feet, 25 feet and 65 feet, 30 feet and 60 feet, 40 feet and 60 feet, or 45 feet and 55 feet below open hole stage tool 143.

According to one or more embodiments, total depth 160 is between 100 feet and 100,000 feet, 500 feet and 80,000 feet, 1,000 feet and 50,000 feet, 2,000 feet and 40,000 feet, 3,000 feet and 35,000 feet, 4,000 feet and 30,000 feet, 5,000 feet and 25,000 feet, 6,000 feet and 20,000 feet, 7,000 feet and 16,000 feet, 8,000 feet and 12,000 feet, or 9,000 feet and 11,000 feet from the surface. In some embodiments, potential loss zone 111 is between 100 feet and 90,000 feet, 500 feet and 80,000 feet, 1,000 feet and 50,000 feet, 2,000 feet and 40,000 feet, 3,000 feet and 30,000 feet, 4,000 feet and 20,000 feet, 5,000 feet and 15,000 feet, 6,000 feet and 12,000 feet, 7,000 feet and 9,000 feet, or 7,500 feet and 8,500 feet from the surface. According to one or more embodiments, open hole stage tool 143 is between 100 feet and 90,000 feet, 500 feet and 80,000 feet, 1,000 feet and 50,000 feet, 2,000 feet and 40,000 feet, 3,000 feet and 30,000 feet, 4,000 feet and 20,000 feet, 5,000 feet and 15,000 feet, 6,000 feet and 12,000 feet, 7,000 feet and 9,000 feet, or 7,500 feet and 8,500 feet from the surface. In some embodiments, outer casing string bottom 121 is between 100 feet and 90,000 feet, 500 feet and 80,000 feet, 1,000 feet and 50,000 feet, 2,000 feet and 30,000 feet, 3,000 feet and 15,000 feet, 4,000 feet and 10,000 feet, 5,000 feet and 8,000 feet, 5,000 feet and 7,000 feet, or 5,500 feet and 6,500 feet from the surface.

In a first cementing stage, a known volume of cement may be pumped down inner casing string 140 through inner casing bottom 146 and up annulus 151 to an expected height. The expected height is calculated based on the volume of cement pumped down inner casing string 140. The expected height is above sensor 145. According to one or more embodiments, the expected height is the height of outer casing string bottom 121.

Inner casing string 140 may comprise open hole stage tool 143, open hole packer 144, and sensor 145 as a fail-safe method to cement a section of casing string in case cement from the first cementing stage fails to reach the expected height. In some embodiments, cement from the first stage of cementing fails to reach the expected height because the volume of annulus 151 is greater than anticipated or cement is lost to the formation 110. In embodiments, cement from the first stage of cementing fails to reach the expected height because the cement flash sets or the wellbore enlarges due to hole instability. According to one or more embodiments, cement from the first stage of cementing fails to reach the expected height because cement is lost to potential loss zone 111. In some embodiments, potential loss zone 111 is an interval of formation 110 that cannot support the pressure of a full cement column. According to one or more embodiments, potential loss zone 111 is an interval of the formation 110 that absorbs cement.

After the first cementing stage, sensor 145 detects a presence or absence of cement. In embodiments, sensor 145 can detect a presence or absence of cement by detecting the weight of the material in annulus 151. Since cement is a heavier material than mud or other formation materials, the sensor can detect a presence or absence of cement by detecting the weight of the material, if any, in the annulus 151. In some embodiments, sensor 145 is a pressure sensor.

In some embodiments, sensor 145 may send a signal to the surface by a control line or by sending a wireless signal when detecting a presence or absence of cement. According to one or more embodiments, sensor 145 may only send a signal to the surface when detecting an absence of cement. Once the signal reaches the surface, a signal processor may process the signal. Based on the signal from sensor 145 indicating an absence of cement, engineers at the surface may begin the process of inflating open hole packer 144 and opening open hole stage tool 143 as is known in the art.

If sensor 145 detects a presence of cement, open hole stage tool 143 is kept closed and open hole packer 144 is kept deflated. In some embodiments, if sensor 145 detects a presence of cement, casing packer 142 is inflated, casing stage tool 141 is opened, and cement is circulated through casing stage tool 141 into the casing to outer casing annulus 150 above casing packer 142.

If sensor 145 detects an absence of cement, open hole packer 144 is inflated, open hole stage tool 143 is opened, and cement is circulated through open hole stage tool 143 into annulus 151 above open hole packer 144 to a predetermined height. The predetermined height may be calculated based on the volume of cement circulated through open hole stage tool 143. In some embodiments, the predetermined height is the same height as the expected height. According to one or more embodiments, the predetermined height is the height of outer casing bottom 121. In some embodiments, the predetermined height is vertically above the expected height. The predetermined height may be vertically above the expected height because a large enough volume of cement is circulated through open hole stage tool 143 to cement the inner casing to outer casing annulus 150. In this scenario, casing packer 142 is never inflated and casing stage tool 141 is never opened.

In some embodiments, after cement is circulated to the predetermined height, casing packer 142 is inflated, casing stage tool 141 is opened, and cement is circulated through casing stage tool 141 into the inner casing to outer casing annulus 150 above casing packer 142.

After cementing, open hole stage tool 143 may be drilled as is known in the art. In some embodiments, open hole stage tool 143 and casing stage tool 141 may be drilled by the same drill bit.

According to an aspect, either alone or in combination with any other aspect, a fail-safe method to cement a section of casing string to a formation includes providing the casing string in a wellbore, the casing string comprising a stage tool, a packer, and a sensor. The packer is located vertically below the stage tool and vertically above the sensor on the casing string. The method further includes pumping cement down the casing string and up an annulus coaxially surrounding the casing string to an expected height, the expected height being a vertical distance above the sensor; and detecting a presence or absence of cement with the sensor. The stage tool is kept closed and the packer is kept deflated based on the sensor detecting the presence of cement; or the packer is inflated and the stage tool is opened based on the sensor detecting the absence of cement.

According to a second aspect, either alone or in combination with any other aspect, cement is circulated through the opened stage tool and up the annulus above the inflated packer to a predetermined height based on the sensor detecting the absence of cement. The predetermined height is a vertical distance above the sensor.

According to a third aspect, either alone or in combination with the second aspect, the predetermined height is the height of an outer casing string bottom in the wellbore.

According to a fourth aspect, either alone or in combination with the second aspect, the expected height is equal to the predetermined height.

According to a fifth aspect, either alone or in combination with any other aspect, the sensor is a pressure sensor.

According to a sixth aspect, either alone or in combination with any other aspect, the formation further comprises a potential loss zone, the potential loss zone being a vertical distance below the pressure sensor.

According to a seventh aspect, either alone or in combination with any other aspect, the sensor sends a signal to the surface after detecting the presence or absence of cement.

According to an eighth aspect, either alone or in combination with any other aspect, the sensor is located between 1 and 100 feet below the stage tool.

According to a ninth aspect, either alone or in combination with the eighth aspect, the sensor is located between 20 and 70 feet below the stage tool.

According to a tenth aspect, either alone or in combination with any other aspect, the expected height is the height of an outer casing string bottom in the wellbore.

According to an eleventh aspect, either alone or in combination with the tenth aspect, the casing string further includes a second stage tool and a second packer, the second stage tool and the second packer above the outer casing string bottom.

It should be understood that any ranges provided herein include the endpoints unless stated otherwise.

It should be understood that any two quantitative values assigned to a property may constitute a range of that property, and all combinations of ranges formed from all stated quantitative values of a given property are contemplated in this disclosure.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A fail-safe method to cement a section of casing string to a formation comprising:

providing the casing string in a wellbore, the casing string comprising a stage tool, a packer, and a sensor, wherein the packer is located vertically below the stage tool and vertically above the sensor on the casing string;

pumping cement down the casing string and up an annulus coaxially surrounding the casing string to an expected height, the expected height being a vertical distance above the sensor;

detecting a presence or absence of cement with the sensor;

keeping the stage tool closed and packer deflated based on the sensor detecting the presence of cement; or inflating the packer and opening the stage tool based on the sensor detecting the absence of cement.

2. The method of claim 1 wherein cement is circulated through the opened stage tool and up the annulus above the inflated packer to a predetermined height based on the sensor detecting the absence of cement, wherein the predetermined height is a vertical distance above the sensor.

3. The method of claim 2 wherein the predetermined height is the height of an outer casing string bottom in the wellbore.

4. The method of claim 2 wherein the expected height is equal to the predetermined height.

5. The method of claim 1 wherein the sensor is a pressure sensor.

6. The method of claim 1 wherein the formation further comprises a potential loss zone, the potential loss zone being a vertical distance below the pressure sensor.

7. The method of claim 1 wherein the sensor sends a signal to the surface after detecting the presence or absence of cement.

8. The method of claim 1 wherein the sensor is located between 1 and 100 feet below the stage tool.

9. The method of claim 8 wherein the sensor is located between 20 and 70 feet below the stage tool.

10. The method of claim 1 wherein the expected height is the height of an outer casing string bottom in the wellbore.

11. The method of claim 10 wherein the casing string further comprises a second stage tool and a second packer, the second stage tool and the second packer above the outer casing string bottom.

* * * * *